US006357685B1

(12) United States Patent
Wibmer

(10) Patent No.: US 6,357,685 B1
(45) Date of Patent: Mar. 19, 2002

(54) SPOOL-COLLAR WITH TRANSPONDER ESPECIALLY FOR SPIN-SPOOLING OF GLASS FIBERS

(75) Inventor: Albert Wibmer, Reutlingen/Württ (DE)

(73) Assignee: Wibmer GmbH u. Co. Kommanditgesellschaft Papier-Formtechnik, Pliezhausen/Wurtt (DE)

( * ) Notice: Subject to any disclaimer, the term of this patent is extended or adjusted under 35 U.S.C. 154(b) by 0 days.

(21) Appl. No.: 09/561,718

(22) Filed: May 1, 2000

Related U.S. Application Data

(63) Continuation of application No. PCT/EP98/06884, filed on Oct. 30, 1998.

(30) Foreign Application Priority Data

Nov. 3, 1997 (DE) ..... 297 19 432 U

(51) Int. Cl.[7] ..... B65H 75/12; B65H 75/14; D01H 9/10

(52) U.S. Cl. ..... 242/118.32; 242/118.8; 242/610.1; 57/281

(58) Field of Search ..... 242/118.3, 118.32, 242/118.7, 118.8, 610.1; 57/281

(56) References Cited

U.S. PATENT DOCUMENTS

| | | | | | |
|---|---|---|---|---|---|
| 3,105,786 | A | * | 10/1963 | Anderson | 242/118.7 X |
| 3,587,656 | A | * | 6/1971 | Cunningham | 242/118.32 X |
| 5,100,073 | A | * | 3/1992 | Moehrke et al. | 57/281 X |
| 5,321,240 | A | * | 6/1994 | Takahira | 235/380 |
| 5,359,160 | A | * | 10/1994 | Wirtz | 57/281 X |
| 5,497,952 | A | * | 3/1996 | Iding | 57/281 X |
| 5,505,395 | A | * | 4/1996 | Qiu et al. | 242/118.32 |
| 5,649,352 | A | * | 7/1997 | Gustafson | 29/605 |
| 6,075,707 | A | * | 6/2000 | Ferguson et al. | 361/750 |
| 6,142,381 | A | * | 11/2000 | Finn et al. | 235/492 |

FOREIGN PATENT DOCUMENTS

| | | | |
|---|---|---|---|
| CH | 686 156 A5 | * | 1/1996 |
| EP | 0 170 094 B2 | * | 5/1988 |

* cited by examiner

*Primary Examiner*—Michael R. Mansen
(74) *Attorney, Agent, or Firm*—Renner, Otto, Boisselle & Sklar, LLP

(57) ABSTRACT

A spool sleeve consisting of several interconnected layers formed by webs, wherein a recess in an inner layer contains an appropriately shaped transponder having a weight that is approximately equal to that of the web material removed to create the recess so that any imbalance of the sleeve with the transponder therein embedded is avoided.

9 Claims, 1 Drawing Sheet

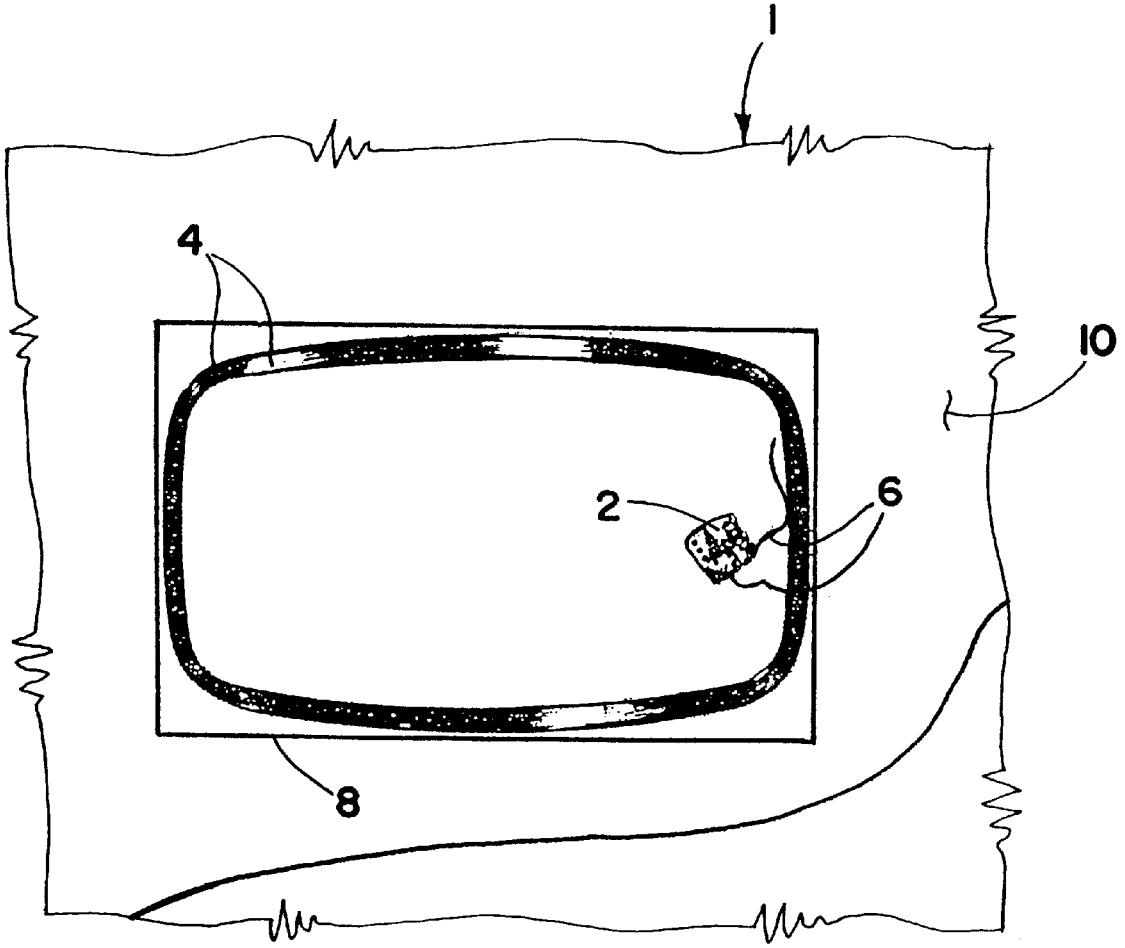
1
4
10
2
6
8

SPOOL-COLLAR WITH TRANSPONDER ESPECIALLY FOR SPIN-SPOOLING OF GLASS FIBERS

RELATED APPLICATION DATA

This application is a continuation of International Patent Application No. PCT/EP98/06884, filed Oct. 30, 1998.

BACKGROUND OF THE INVENTION

The invention concerns a spool sleeve of the type known, for example, from the EP 0.170.094 B2 (Wibmer), where wound webs are glued together.

With such sleeves, a barcode along with written text beside it is applied to the rim of the sleeve on both sides during the manufacture of the sleeve. This multi-digit barcode serves to identify the sleeve and contains the production data of the material spooled on this sleeve. It frequently happens that these optical markings are covered by a layer of dirt or are damaged during the repeated use of the sleeve so that they can no longer be read by the human eye or by a barcode scanner. In that case, the sleeve needs to be replaced by a new one even though it would be sound enough to be reused many more times.

From CH 686.156 A5, a data carrier for material identification and for the transportation of data along with the material in the textile industry was previously known. In the case of a spool sleeve for yarn as material, this machine-readable data carrier is an integrated circuit, i.e. a chip with an antenna embedded in the sleeve wall in order to avoid damage during use of the sleeve. Here, however, the sleeve does not consist of a spool made up of multiple layers of which one contains a recess for embedding the transponder, and also does not provide for imbalance compensation.

SUMMARY OF THE INVENTION

It is the objective of the invention to avoid the aforesaid disadvantage and to create a sleeve of the above-mentioned type which can be used ten times as often while still allowing the marking of the sleeve itself and thus making it possible to identify the sleeve with the help of these markings.

The invention solves this problem in a spool sleeve, specifically for spooling glass fibers; with several interconnected layers, specifically layers glued to each other, consisting specifically of webs made of fleece, plastic film, or fabric-reinforced rubber, by the provision of an inner layer that has a recess into which an appropriately shaped transponder is embedded, whose weight is approximately equal to the weight of the web piece that was cut out. The transponder (microelectronic data carrier) for identifying the sleeve by means of individual data stored in the transponder which can be read with hand-held or stationary electronic reading devices does not require an unobstructed path between the sleeve surface and the eye (in case of numbers) or the sleeve surface and the scanner (in case of barcodes). This means that it can be placed below the surface of the sleeve, especially since the signal between the transponder and the reading device is transmitted by means of radio transmission, with the transponder being powered not by a battery but by the electromagnetic field of the reading device.

As a consequence, the identifying data of the sleeve that are stored in the transponder and are transmitted to the reading device upon demand are not subject to any wear even during frequent use of the sleeve so that the strength of the sleeve material alone determines the length of its useful life.

Suitable design variants of the sleeve proposed by the invention are characterized by:

- the feature that the transponder consists of a microchip and a ring coil serving as an antenna surrounding the chip, with the chip and the coil arranged on the same plane; and that this relative position of the chip and the coil is secured by an electromagnetically passive film on which at least the chip and the connecting wires to the coil are located;
- a double film in form of a shallow pocket whose edges are vacuum sealed and which also encloses the coil;
- the feature that the film pocket is held by means of a strip of its edge in the web recess; and
- by the feature that the layer with the recess is one of the center layers, and that the recess is centered between its edges.

The invention is suitable for sleeves of the type known from EP 0.170.094 B2, where fleece, plastic film, or fabric-reinforced rubber are used as web materials.

Either read-only memory (ROM) or random access memory (RAM) may be used as the transponder memory for the individual identification of the sleeve. The latter allows changes of the identification data.

Below, the invention is explained in detail with the help of a design variant of the sleeve as proposed by the invention, shown in exemplary fashion in the drawing.

BRIEF DESCRIPTION OF THE DRAWING

The only FIGURE of the drawing shows a fragmentary top view of the marking zone of this variant with the characteristic design proposed by the invention, wherein an outer layer of a sleeve is broken away to show a recess containing the transponder.

DETAILED DESCRIPTION

In this design variant, the heat resistant transponder embedded in the sleeve 1 consists primarily of a microchip 2 and an oval coil 4 serving as receiving and transmitting antenna. The microchip and coil both are held in fixed position in a shallow film pocket in such fashion that the connecting wires 6 between the chip 2 and the coil 4 remain undamaged. This transponder with a thickness of approximately 0.5 mm and an approximately rectangular size of approximately 65 by 43 square millimeters is commercially available as of now, and is fitted into an approximately rectangular recess 8 in one 10 of several layers whose thickness corresponds to that of the transponder 2, 4, 6. These layers consist of webs, for example, that are spiral-wound to form a sleeve.

What is claimed is:

1. A spool sleeve for spooling glass fibers comprising interconnected layers, the interconnected layers including a layer having a recess; and a transponder disposed within the recess and having a weight approximately equal to the weight of a portion of the layer corresponding in size to the recess.

2. A sleeve according to claim 1, wherein the transponder includes a microchip and a ring coil serving as an antenna surrounding the chip, with the chip and the coil arranged on the same plane and maintained in relative position by an electromagnetically passive film on which at least the chip and connecting wires to the coil are located.

3. A sleeve according to claim 2, wherein the electromagnetically passive film has two layers forming a shallow pocket, the edges of which are vacuum sealed, and wherein the coil is enclosed within the pocket.

4. A sleeve according to claim 3, wherein the pocket is held at its edge in the web recess.

5. A sleeve according to claim 4, wherein the layer with the recess is an inner one of the interconnected layers.

6. A sleeve according to claim 2, wherein the layer with the recess is an inner one of the interconnected layers.

7. A sleeve according to claim 3, wherein the layer with the recess is an inner one of the interconnected layers.

8. A sleeve according to claim 1, wherein the layer with the recess is an inner one of the interconnected layers, and the recess is centered between the edges of said inner one of said interconnected layers.

9. A sleeve according to claim 1, wherein the intermediate layers are glued to each other and are made of fleece, plastic film or fabric-reinforced rubber.

* * * * *